US009732760B2

(12) United States Patent
Ree

(10) Patent No.: US 9,732,760 B2
(45) Date of Patent: Aug. 15, 2017

(54) IMPELLER FOR CENTRIFUGAL PUMP AND USE THEREOF WHEN PUMPING DRILL FLUID CONTAINING CUTTINGS

(71) Applicant: ENHANCED DRILLING AS, Straume, Fjell Kommune (NO)

(72) Inventor: Sigurd Ree, Loddefjord (NO)

(73) Assignee: ENHANCED DRILLING AS, Straume (NO)

( * ) Notice: Subject to any disclaimer, the term of this patent is extended or adjusted under 35 U.S.C. 154(b) by 243 days.

(21) Appl. No.: 14/441,209

(22) PCT Filed: Nov. 7, 2013

(86) PCT No.: PCT/NO2013/050188
§ 371 (c)(1),
(2) Date: May 7, 2015

(87) PCT Pub. No.: WO2014/073976
PCT Pub. Date: May 15, 2014

(65) Prior Publication Data

US 2015/0292516 A1 Oct. 15, 2015

(30) Foreign Application Priority Data

Nov. 12, 2012 (NO) ..... 20121328

(51) Int. Cl.
*F04D 29/22* (2006.01)
*F04D 7/04* (2006.01)
(Continued)

(52) U.S. Cl.
CPC ..... *F04D 29/2294* (2013.01); *F04D 7/04* (2013.01); *F04D 7/045* (2013.01);
(Continued)

(58) Field of Classification Search
CPC ..... F04D 29/2294; F04D 7/04; F04D 7/045; F04D 29/2216; F04D 29/242; F04D 29/22; F04D 29/222; F04D 29/2288
(Continued)

(56) References Cited

U.S. PATENT DOCUMENTS 4,936,744 A * 6/1990 Dosch ..... D21D 5/26 415/143
4,940,385 A 7/1990 Gurth
(Continued)

FOREIGN PATENT DOCUMENTS

CA 2015572 A1 10/1990
NO 172308 B 3/1993
(Continued)

*Primary Examiner* — Kenneth Bomberg
*Assistant Examiner* — Sabbir Hasan
(74) *Attorney, Agent, or Firm* — Foley & Lardner LLP

(57) ABSTRACT

An impeller for a centrifugal pump for pumping fluid containing solid particles includes: a rear side wall; a front side wall; a plurality of vanes located between the rear side wall and the front side wall, each vane having an outer edge and a vane width in an axial direction of the impeller. At least one of a periphery of the rear side wall or a periphery of the front side wall projects by a radial distance beyond the outer edges of the vanes, the radial distance being at least 0.5 times the vane width.

10 Claims, 3 Drawing Sheets

(51) Int. Cl.
*F04D 29/24* (2006.01)
*F04D 29/42* (2006.01)

(52) U.S. Cl.
CPC ..... *F04D 29/2216* (2013.01); *F04D 29/2288* (2013.01); *F04D 29/242* (2013.01); *F04D 29/426* (2013.01)

(58) Field of Classification Search
USPC ..... 416/182, 183
See application file for complete search history.

(56) References Cited

U.S. PATENT DOCUMENTS

| | | | |
|---|---|---|---|
| 5,615,997 | A | 4/1997 | Höglund et al. |
| 2014/0086736 | A1 | 3/2014 | Ree |

FOREIGN PATENT DOCUMENTS

| | | | |
|---|---|---|---|
| NO | 307146 | B1 | 2/2000 |
| NO | 20110356 | A1 | 9/2012 |

* cited by examiner

IIIB–IIIB

IIIA–IIIA

IMPELLER FOR CENTRIFUGAL PUMP AND USE THEREOF WHEN PUMPING DRILL FLUID CONTAINING CUTTINGS

This invention relates to an impeller in a centrifugal pump particularly suitable for pumping drill fluid with cuttings from an underwater position at the wellhead or from an intermediate position on an underwater riser to a drilling rig.

Among characteristic requirements for such operations are mentioned:

- Transporting cuttings of varying sizes and hardnesses, with a risk of random occurrences of stones of up to Ø 50 mm or more.
- The solid-liquid mixture ratio is given by the application, typically 1-3%, and cannot be optimized on account of the pump.
- The flow rate varies frequently, regularly down to zero while maintaining the pressure head when a drill string is being lengthened.
- The combination of pressure head, flow rate and large-stone passage makes the pump rarely operate at its best efficiency point (BEP).
- Possible back-flow of cuttings over periods of full stop in the flow rate must not lead to clogging or other problems, for quick restoring of the flow rate.
- The cuttings should not be comminuted by the pump so that they become more difficult to separate.
- The drilling fluid will have considerable variations in density and viscosity.
- The erosive properties of the medium vary a great deal and are only partially predictable. The combinations of high pressure head and flow rate periodically way off the BEP will typically involve an increased risk of critical erosive wear.
- It is not desirable to have a large erosion margin in the form of thicknesses of material that give large weight, because we have to do with intermittent, portable equipment which is to be hoisted to and from points of operation at sea depths of several hundred meters.

Until now, substantially, special disc pumps have been used for the purpose, for example as described in U.S. Pat. No. 4,940,385. These are in principle centrifugal pumps in which the impeller consists of discs without vanes, but with certain recesses or other resistance elements. The fluid is accelerated tangentially by means of shear forces. This has the advantage of solid particles getting a substantially lower tangential velocity than the fluid, so that the erosion will be reduced. However, the efficiency and pressure head are substantially reduced in relation to those of centrifugal pumps with vanes.

In the Norwegian patent application 20110356, a roto-dynamic pump for varying flow rate is disclosed, for example suitable for recirculating drill fluid and transporting cuttings from an underwater drilling operation to a separator on a surface installation. In this pump, solid particles that are hurled out by the impeller are carried towards an internal wall of the pump casing, the internal wall being rotationally symmetrical around the same axis as the impeller, but having an increasing diameter in the axial direction towards a pump outlet that cuts through the internal wall of the casing at the largest diameter thereof, and axially to one side of where the particles leave the periphery of the impeller.

However, a disadvantage attached to the pump casing in accordance with the Norwegian patent application 20110356 is that the pump casing will have a relatively large volume and the liquid thereby an increased dwell time, especially by a lower flow rate. Even if most of the solid particles leave the pump casing quicker than the fluid particles, a longer dwell time with several turns for the fluid in the pump casing will give the pump an increased friction loss and reduced efficiency.

The invention has for its object to remedy or reduce at least one of the drawbacks of the prior art or at least provide a useful alternative to the prior art.

The object is achieved according to the invention through the features that are specified in the description below and in the claims that follow.

According to a first aspect of the invention, an impeller for a centrifugal pump which is intended for pumping fluid containing solid particles is provided, the impeller having a rear sidewall and a front sidewall, and a number of vanes, with an outer edge and a vane width in the axial direction, being arranged between the rear side wall and the front side wall, and the impeller being characterized by at least one of the periphery of the rear side wall and the periphery of the front side wall projecting by a radial distance beyond the outer edge of vanes, the radial distance being at least 0.5 times the vane width.

By their increasing tangential speed by an increasing radius, the side walls of the impeller outside the outer edge of the vanes contribute to increasing the pressure head of the pump. At the same time, the velocity gradient of the flow medium where it leaves the vanes is reduced so that the risk of cavitation or other erosive wear on the outer edge of the vanes is reduced. Erosion on the side walls of the impeller will also be moderate as the speed of the impeller lies closer to the mean velocity of the fluid than the static side faces of the pump casing do.

Between the outer side walls of the impeller and the inner side faces of a pump casing, in radial positions between the outer edge of the vanes and the periphery of the impeller, the impeller of the invention will result in an increased velocity gradient towards the walls of the pump casing. However, here the erosion will be limited by solid particles evading this zone because, with their greater density, they may only with difficulty travel from the periphery of the impeller and radially inwards in the zone.

In an otherwise unchanged pump casing, in which the impeller according to the invention assumedly fits, the increased volume within the impeller will reduce the remaining volume outside the impeller, thereby reducing the time of flow and the rotation cycles of the fluid in the region in which friction against the side walls causes loss. This will help to increase the efficiency of the pump.

The part of the side wall that projects from the outer edge of the vanes may have a concave curve towards the opposite side wall.

The peripheries of both side walls may, as mentioned, project substantially beyond the outer edge of the vanes, and the internal faces of both sidewalls outside the outer edge of the vanes may be approximately perpendicular to the rotational axis of the impeller.

The impeller may be provided with vanes of more than one vane type, the vane types being organized in mutually like groups and evenly distributed over the circumference of the impeller.

The different vane types may differ from each other at least by having different radiuses at their respective entrance positions.

A front face on the vane type that has the greatest radius at its entrance position may have a pitch angle at its outer edge, measured relative to a tangent to the periphery, larger than the pitch angle of the vane type that has a smaller radius at its entrance position.

The eye of the impeller may have radial recesses along its circumference, the number of recesses corresponding to the number of vanes that have the smallest radius at their entrance position, and each recess having a smallest radius immediately behind the vane type that has the smallest radius at its entrance position, and the radius being gradually increased in a portion and the radius relatively abruptly decreasing again over a portion immediately in front of the entrance position of the next like vane type.

The front side wall of the impeller may have a substantially larger axial thickness at the eye than at the periphery, and the material around the recesses in the eye is sufficiently hard and cornered to help, during the rotation of the impeller, to crush stones or other particles in the fluid flow.

According to a second aspect of the invention, the impeller is used in a centrifugal pump arranged for pumping drill fluid and cuttings.

The impeller is used in a pump casing suitable therefor, in which the internal wall of the pump casing forms approximately circular, concentric profiles in all lateral sections between the axially outer positions of the flow area of the impeller at the periphery of the impeller, the circular profiles having continuously increasing radiuses from one towards the other of said axially outer positions, and in which a tongue that cuts off the outlet or outlet opening from the annular space of the pump casing does not touch said circular profiles between said outer positions.

Apart from being shown in the patent application 20110356, a pump casing that meets these criteria is also shown in another design in FIG. 4 of the present application. This embodiment helps, among other things, to carry erosive particles rapidly towards a larger radius where the circulation rate is smallest and the outlet is nearest. This also helps to minimize the vulnerability of the impeller to particles returning to the pump casing when the flow has ceased and the impeller is rotating to maintain the static liquid column while new drill pipes are being connected. A further advantage of said and similar uses is that the fluid flow will not kick back into the impeller to any great extent when the outlet tongue is being passed and the flow rate lies considerably below the BEP, which is a known problem, especially in centrifugal pumps with a snail shell adapted for the design BEP.

The present invention provides an impeller which, in relation to the prior art, is designed to efficiently transport fluid with relatively large, solid particles. The advantages of the impeller increase when the impeller is used in a pump casing in accordance with the Norwegian patent application 20110356.

In what follows, an example of a preferred embodiment is described, which is visualized in the accompanying drawings, in which.

Figure 3A:
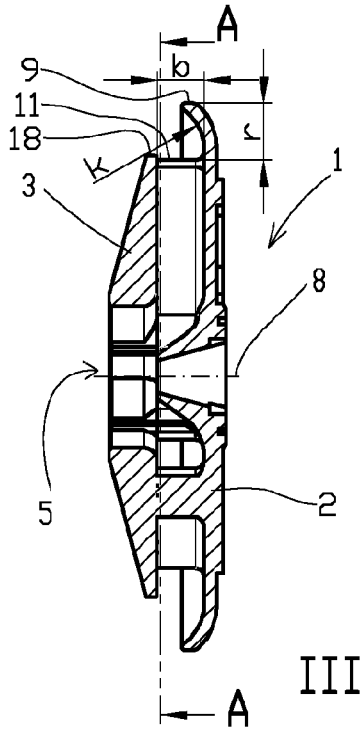
FIGS. 3A and 3B show the exemplary embodiment of FIG. 1, FIG. 3A showing a section IIIB-IIIB from FIG. 3B, from which the designs of the different side walls of this embodiment appear.
Figure 3B:
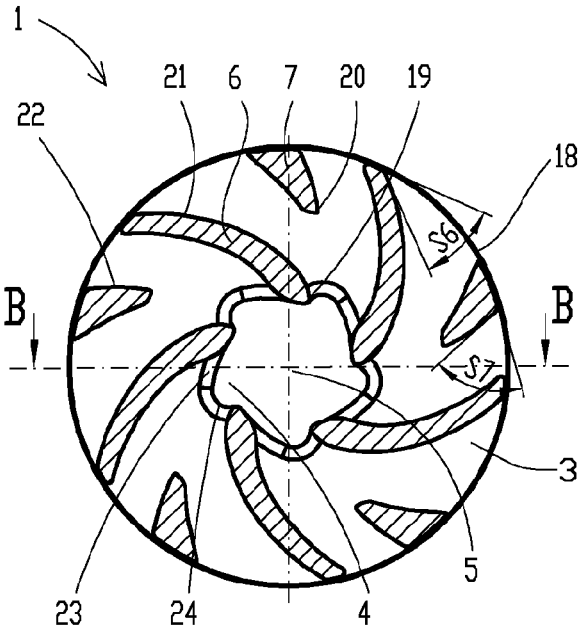
Figure 4:
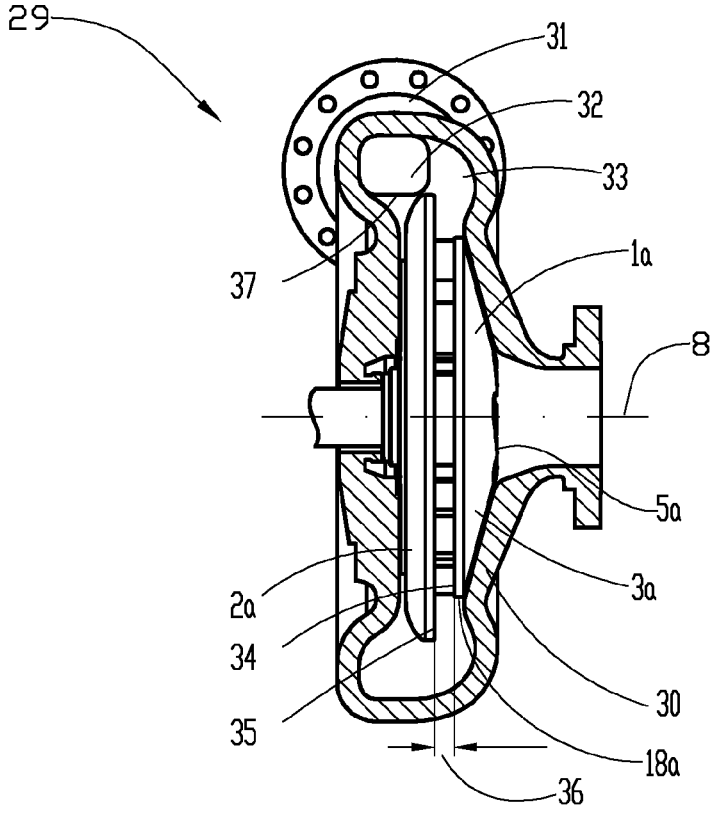

FIG. 3B shows the section IIIA-IIIA of FIG. 3A, so that especially the designs of the vanes and the eye, that is to say the opening of the impeller on the suction side, appear; and FIG. 4 shows a use of the impeller in which it is being utilized in a pump casing which is formed in accordance with the Norwegian patent application 20110356, but in which the design of the impeller has enabled a design of the pump casing with reduced volume, axial extent and time of flow.

In the drawings, the reference numeral 1 indicates an impeller which includes a rear side wall 2, a front side wall 3 and a number of vanes, the vanes consisting of a first vane type 6 and a second vane type 7. The impeller 1 rotates around an axis of rotation 8.

In what follows, the first vane type 6 and the second vane type 7 are termed vanes 6, 7 when it is practical to refer to them collectively. The vanes 6, 7 have a width b, see FIG. 3A, and an outer edge 11. Correspondingly, the rear side wall 2 and the front side wall 3 are termed side walls 2, 3.

The front side wall 3 is provided with an inlet opening which is termed an eye 5 here. The rear side wall 2 projects by a distance r, see FIG. 2, from the outer edge 11 of the vanes 6, 7. The distance r is larger than 0.5*b.

The medium which is to be pumped is sucked into the eye 5 of the impeller, and is accelerated by the vanes 6, 7 between the rear side wall 2 and the front side wall 3 of the impeller. The medium is affected by shear forces in the rotational direction from at least one of the side walls 2, 3 of the impeller 1 after having passed the outer edge 11 of the vanes, so that the tangential velocity of the medium either decreases slowly or continues accelerating until the medium has left the impeller 1 completely. In such a way, a pump with an impeller 1 in accordance with the invention provides a combination of the properties of a classical centrifugal pump with vanes and a disc pump with an impeller without vanes.

The medium to be pumped typically includes a fluid with solid particles.

Figure 2:
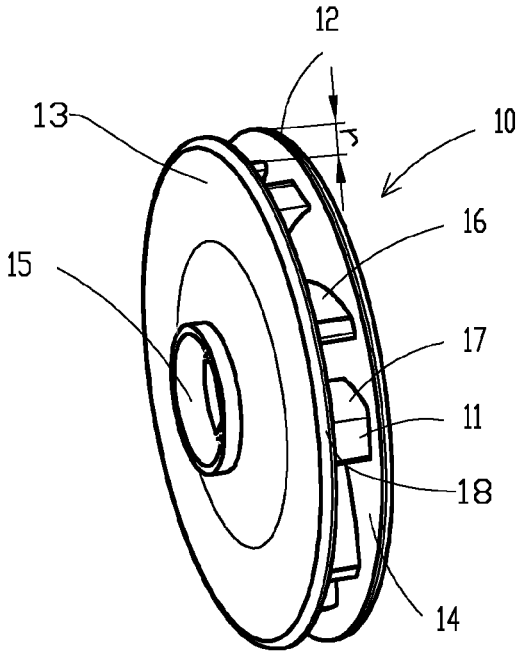
FIG. 2 shows in perspective another exemplary embodiment of the invention, in which both side walls project substantially beyond the outer edge of the vanes.

FIG. 2 shows a simple embodiment of an impeller 10 in accordance with the invention. Here, the rear side wall is indicated by 12, the front side wall by 13, the third vane type by 16 and the fourth vane type by 17. Here, both the rear side wall 12 and the front side wall 13 project from the outer edge 11 of the vanes 16, 17.

The medium to be pumped, is sucked into a central, cylindrical opening, here termed the eye 15, in the front side wall 13 of the impeller 10. From here, the medium is accelerated between the vanes 16, 17 out towards the outer edge 11 of the vanes 16, 17. Outside the outer edge of the vanes 16, 17, the medium will still be affected in the rotational direction by shear forces between the medium and the side walls 12, 13 of the impeller 10. Solid particles with greater densities than the fluid, on their part, will tend to achieve a greater radial velocity, but a lower tangential velocity than the fluid and will be affected to a smaller extent than the fluid by the side walls 12, 13 outside the outer edge 11 of the vanes.

Figure 1:
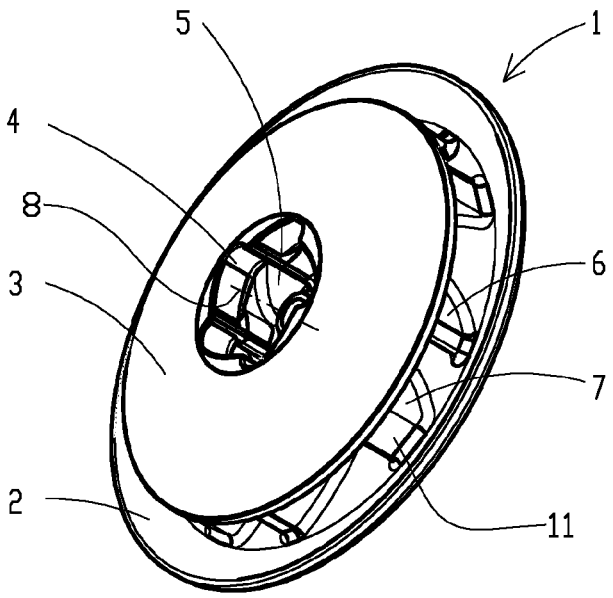
FIG. 1 shows in perspective an exemplary embodiment of an impeller in accordance with the invention, in which only one of the side walls projects substantially beyond the outer edge of the vanes.

A more complex embodiment of an impeller 1 in accordance with the invention is shown in FIG. 1, in which the front side wall 3 with the eye 5 does not project beyond the outer edge of the vanes 6, 7 like the rear side wall 2 does. Outside the outer edge 11 of the vanes 6, 7, the rear side wall 2 on its part is curved inwards in a curve k, see FIG. 3A, in the direction of the front side wall 3.

As, for example, cuttings, for whose transport the impeller 1 is particularly intended, may contain random occurrences of larger stones ("dropstones"), and as a larger distance between the side walls 2, 3 to make room for larger stones will reduce the efficiency of a pump, not shown, at the most relevant specific rates, the eye 5 of this exemplary embodiment is provided with recesses 4, the shape of the recesses 4 causing the larger stones to be crushed during operation, if they do not readily pass the transition between the eye 5 and the side walls 2, 3. At the same time, the recesses 4 are arranged to guide stones to the right entrance position of the first vanes 6. In this way, impacts between the stones and the first vanes 6, which could otherwise cause considerable damage over time, are dampened. At the same time, the rotational velocity of the fluid upstream of the first vanes 6 is increased, so that the risk of cavitation behind the first vanes 6 is reduced.

FIG. 3A, together with FIG. 1, elucidates how the front side wall 3 of this exemplary embodiment has an increasing thickness of material from the periphery 18 in towards the eye 5. The relatively large thickness at the eye 5 helps to increase the lifetime of the impeller 1 when pumping fluids with significant occurrences of large stones.

FIG. 3B which shows a section A-A of FIG. 3A, elucidates the designs of the eye 5 and the vanes 6, 7 in this exemplary embodiment. The first vane type 6 is different from the second vane type 7.

The first vane type 6 has a substantially smaller entrance radius at its entrance position 19 than the second vane type 7 has at its entrance position 20. They have equal or approximately equal outlet radiuses near the periphery 18 of the front side wall 3. The first vane type 6 and the second vane type 7 are arranged in a number of like groups, here five, evenly distributed over the circumference of the impeller 1.

The impeller 1 is constructed to rotate clockwise as it is seen in FIG. 3B. In principle, the entrance position 19 of the first vane type 6 coincides with the smallest radius of the eye 5.

The radius of the recesses 4 of the eye 5 varies along the circumference. Over a portion 23 immediately behind the entrance position 19 of each first vane type 6, the recesses 4 are gradually widened, whereas they are terminated relatively abruptly in a portion 24 immediately in front of the front face 21 of the following first vane type 6. In that way, the recesses 4 shall help to guide larger stones, in particular those that are crushed in the recesses 4, directly into entering against the front face 21 of the first vane type 6 so that the energy in the impact of the stones against the entrance position 19 of the first vane type 6 is limited.

In the exemplary embodiment in FIG. 1, the first vane type 6 has a relatively reclined shape, illustrated by the pitch angle S6 at the outer edge 11 of these vanes (see FIG. 3B). Indeed, a low pitch angle S6 reduces the tangential outlet velocity of the fluid and thereby the pressure head, especially by a great flow rate and the associated, relatively great radial velocity. However, solid particles of greater densities than the fluid will have a greater radial velocity than the latter and a proportionately more reduced tangential velocity, which is desirable with regard to erosion.

The number of vanes of the first type 6 is restricted by, among other things, the radius at the entrance position 19, by design requirements for the largest solid particle to pass, the necessary thickness of material to resist impacts at the entrance position 19 of the first vane type 6, and requirements for rear-face rounding to avoid cavitation in this region. Requirements for lifetime when transporting cuttings or slurry call for a small entrance radius, whereas requirements for pressure head call for a considerably larger outlet radius for the vanes 6, 7. In principle, a large radial extent of the vanes 6, 7 is unfavourable to the efficiency because, with only like vanes 6, 7, it means a large distance between the vanes at the outer edges thereof and thereby insufficient guidance of the fluid flow. However, the larger radius of the periphery 9 of the rear side wall 2 in accordance with to the invention contributes to increasing the pressure head and thereby limiting somewhat the requirement for the radius of the vanes 6, 7 at the outer edge 11.

Another contribution to the pressure head and the efficiency of the pump not shown is achieved by the introduction of the vane type 7 which has a larger entrance radius at its entrance position 20 between the vanes of the first vane type 6. These vanes of the second vane type 7 are arranged in such a way that stones of the design size may pass either at the back, if they follow the front face 21 of the first vane type 6, or at the front face 22 of the second vane type 7 if carried thereto by the recoil from the impact against the front face 21. However, the fluid flow in front of the front face 22 of the second vane type 7 is mainly assumed to have less entrained cuttings or other solid material than the fluid flow that is guided by the front face 21 of the first vane type 6. Therefore, without any substantial disadvantage to the erosion resistance of the impeller 1, the second vane type 7 may be given a larger pitch S7 (see FIG. 3B) which gives increased pressure head for the pump not shown, in addition to the increased efficiency resulting from a better guided fluid flow by a shorter distance between the vanes 6, 7.

The second vane type 7 with increased thickness towards the outlet at the periphery 18 of the front side wall 3 will have a lower outlet angle at the back of the second vane type 7 and thereby a decreased risk of cavitation in this region. This gives increased solidity and operative life in an erosive environment. However, this embodiment will be favourable only in a pump in which the design passage between the side walls 2, 3 is relatively large and the radial velocity is proportionately lower. The advantage of a large thickness of material at the outlet of the vanes 6, 7 would probably also be limited if it were not combined with the extension of at least one of the side walls 2, 3 of the impeller 1 beyond the outlet position of the vanes 6, 7 at the outer edge 11. This extension in accordance with the main claim of the present invention contributes to a reduced velocity gradient and a less turbulent flow pattern at the outer edge of the vanes 6, 7.

The invention also includes a device which describes that the impeller 1 in accordance with the invention is used in a centrifugal pump arranged for pumping drill fluid and cuttings. This is considered to be sufficiently elucidated by the above description of the design of the impeller 1 and by the description below connected to FIG. 4.

FIG. 4 shows an impeller 1*a*, in principle corresponding to the embodiment shown in FIGS. 1, 3*a* and 3*b*, used in a pump casing 30 in accordance with the Norwegian patent application 20110356.

The pump casing 30 has an outlet 31 and an outlet opening 32. The internal wall of the pump casing 30 is indicated by 33, whereas the rear side wall 2*a* of the impeller 1*a* has an outer position 35 and the front side wall 3*a* has an outer position 34 at the periphery of the impeller 1*a*. The eye of the impeller 1*a* is indicated by 5*a*. The distance between the side walls 2*a*, 3*a* is indicated by 36 in FIG. 4. The pump casing has a tongue 37.

In the patent application NO 20110356 a pump casing is described, which is characterized by the fact that in all positions radially to the axis of rotation and in axial positions between the outer positions 34, 35 of the flow area of the impeller 1*a* at the periphery thereof, the internal wall 33 of the pump casing forms approximately circular profiles which are, in the main, concentric and have continuously increasing radiuses from one outer portion 34 towards the other outer portion 35 of said axially outer positions, and that the tongue 37 that cuts off the outlet 31 or the outlet opening 32 of the pump from the annular space of the pump casing 30 does not touch said circular profiles between said outer positions 34, 35.

In connection with the pump casing 30, the impeller 1*a* of the present invention represents a further improvement of the roto-dynamic pump for varying output flow which has been described earlier in the Norwegian patent application 20110356, in that the forward-sloping side wall 2 limits the axial extent of the flow area of the impeller 1*a*, illustrated here by the distance 36, at the periphery of the impeller 1*a* and in that this helps to reduce the volume of the pump 29 and time of flow of the fluid in the pump casing 30, and also the outer overall dimensions of the pump casing 30 in the axial direction.

However, the invention is not dependent on a particular pump casing 30 to fulfill its purpose. Neither are the device claims restricted by the features that are specified in the usage claims.

For example, an impeller 10 in accordance with FIG. 2 will be beneficial in a slurry pump, not shown, for the mining industry, possibly combined with a mainly cylindrical pump casing with its outlet placed axially midway between the side walls 12, 13 of the impeller 10. As this type of slurry pump, not shown, possibly has a large concentration of solids, typically around 30%, there will be a larger presence of solid particles at the periphery of the vanes than in applications for drill fluid and cuttings in which the solids make up a smaller proportion of the pump medium. The reduced velocity gradient at the outer edge 11 of the vanes 16, 17 will proportionately help more to reduce erosive degradation of the outer edge 11 of the vanes, which is otherwise a known problem in slurry pumps.

In conclusion, it should be pointed out that an exemplary embodiment of the impeller 1, 1*a*, not shown, in which only one side wall 2, 3 projects beyond the outer edge of the vanes 6, 7 as in FIG. 1, but in which that is the front side wall 3 through which the fluid is sucked in through an eye 5 arranged therefor, lies within the scope of protection of the invention as well.

The invention claimed is:

1. An impeller for a centrifugal pump for pumping fluid containing solid particles, the impeller comprising:
- a rear side wall;
- a front side wall;
- a plurality of vanes located between the rear side wall and the front side wall, each vane having an outer edge and a vane width in an axial direction of the impeller,
- wherein at least one of a periphery of the rear side wall or a periphery of the front side wall projects by a radial distance beyond the outer edges of the vanes, the radial distance being at least 0.5 times the vane width.

2. The impeller in accordance with claim 1, wherein a part of the side wall that projects beyond the outer edges of the vanes has a concave curve towards the opposite side wall.

3. The impeller in accordance with claim 1, wherein the peripheries of both side walls project beyond the outer edges of the vanes and, outside the outer edges of the vanes, internal faces of both side walls are approximately perpendicular to the axial direction of the impeller.

4. The impeller in accordance with claim 1, wherein the plurality of vanes include a first group of vanes of a first vane type, and a second group of vanes of a second vane type, the vanes of the first group being evenly distributed over a circumference of the impeller, and the vanes of the second group being evenly distributed over the circumference of the impeller.

5. The impeller in accordance with claim 4, wherein each of the vanes in the first and second groups of vanes has an entrance position, and a radial position of the entrance positions of the vanes in the first group is different than a radial position of the entrance positions of the vanes in the second group.

6. The impeller in accordance with claim 5,
- wherein a radial position of the entrance positions of the vanes in the second group is radially outward of a radial position of the entrance positions of the vanes in the first group, and
- a pitch angle of the outer edges of the vanes in the second group, measured relative to a tangent to the periphery of at least one of the side walls, is larger than a pitch angle of the outer edges of the vanes in the first group.

7. The impeller in accordance with claim 4,
- wherein a radial position of the entrance positions of the vanes in the second group is radially outward of a radial position of the vanes in the first group,
- wherein an eye of the impeller has radial recesses along its circumference, and a number of recesses corresponds to a number of vanes in the first group, and
- wherein an edge of each recess begins at a location adjacent to an entrance position of a first corresponding one of the vanes in the first group, gradually extends radially outward, and then relatively abruptly extends radially inward to a location adjacent to an entrance position of a second corresponding one of the vanes in the first group.

8. The impeller in accordance with claim 7, wherein an axial thickness of the front side wall at the eye is greater than an axial thickness of the front side wall at the periphery of the front side wall.

9. A centrifugal pump for pumping fluid containing solid particles, the centrifugal pump comprising:
- an impeller comprising:
  - a rear side wall;
  - a front side wall;
  - a plurality of vanes located between the rear side wall and the front side wall, each vane having an outer edge and a vane width in an axial direction of the impeller,
  - wherein at least one of a periphery of the rear side wall or a periphery of the front side wall projects by a radial distance beyond the outer edges of the vanes, the radial distance being at least 0.5 times the vane width.

10. The centrifugal pump in accordance with claim 9, further comprising:
- a pump casing in which the impeller is disposed, the pump casing including an internal wall having circular, concentric profiles in lateral sections between axially outer positions of a flow area of the impeller at a periphery of the impeller, the profiles having continuously increasing radii from one axial outer position to another axial outer position,
- a tongue that separates one or more outlet openings of the pump from an annular space of the pump, wherein the tongue does not touch the profiles between the outer positions of the flow area of the impeller.

* * * * *